United States Patent [19]

Yukumoto et al.

[11] Patent Number: 4,964,583

[45] Date of Patent: Oct. 23, 1990

[54] METHOD OF TRANSPORTING RAPIDLY QUENCHED RIBBON AND APPARATUS THEREFOR

[75] Inventors: Masao Yukumoto; Kiyoshi Shibuya; Nobuyuki Morito; Teruo Hiramatsu, all of Chiba, Japan

[73] Assignee: Kawasaki Steel Corporation, Kobe, Japan

[21] Appl. No.: 271,740

[22] Filed: Nov. 15, 1988

[30] Foreign Application Priority Data

| | | | |
|---|---|---|---|
| Nov. 19, 1987 | [JP] | Japan | 62-290477 |
| Nov. 30, 1987 | [JP] | Japan | 62-299886 |
| Dec. 28, 1987 | [JP] | Japan | 62-330267 |
| Jun. 20, 1988 | [JP] | Japan | 63-150006 |

[51] Int. Cl.[5] ..... B65H 19/26

[52] U.S. Cl. ..... 242/56 R; 242/78.3; 226/97; 226/182; 226/186

[58] Field of Search ..... 242/56 A, 56 R, 78.1, 242/78.3; 226/7, 97, 176, 178, 182, 186, 188, 191; 164/423, 463; 29/120

[56] References Cited

U.S. PATENT DOCUMENTS

| | | | |
|---|---|---|---|
| 3,087,599 | 4/1963 | Nelson | 29/120 X |
| 3,805,652 | 4/1974 | LaLonde et al. | 242/56 R |
| 4,415,108 | 11/1983 | Katoh | 226/176 X |
| 4,466,578 | 8/1984 | Shibuya et al. | 226/97 X |
| 4,520,645 | 6/1985 | Ross et al. | 226/97 X |
| 4,553,712 | 11/1985 | Krywiczanin et al. | 226/97 X |
| 4,630,783 | 12/1986 | Mulfarth | 242/56 A |
| 4,667,863 | 5/1987 | Brunner et al. | 226/184 X |
| 4,695,005 | 9/1987 | Gietman | 242/56 R |
| 4,726,502 | 2/1988 | Cryderman | 226/97 |
| 4,766,947 | 8/1988 | Shibuya et al. | 164/463 X |

FOREIGN PATENT DOCUMENTS

| | | |
|---|---|---|
| 0021049 | 1/1981 | European Pat. Off. . |
| 0115026 | 8/1984 | European Pat. Off. . |
| 0166884 | 1/1986 | European Pat. Off. . |
| 181083 | 3/1906 | Fed. Rep. of Germany . |
| 3024426 | 1/1982 | Fed. Rep. of Germany . |

OTHER PUBLICATIONS

Patent Abstracts of Japan, vol. 7, No. 98 (M—210) (1243), Apr. 26, 1983, & JP—A—58 22 244 (Yokohama Gomu K.K.) 09—02—1983.

*Primary Examiner*—John M. Jillions
*Attorney, Agent, or Firm*—Dvorak and Traub

[57] ABSTRACT

A method and an apparatus for transporting a rapidly quenched ribbon from a cooling roll to a winding reel by a pinch roll are disclosed. The pinch roll comprises a brush roll and a solid roll for transporting the ribbon such as to maintain an adequate tension in the ribbon without any transversal displacement and breakdown of ribbon. The tension is controlled within a range of 2~8 kgf by adjusting at least one of an amount of pressing of the brush roll against the solid roll, a pressing force on the brush roll and a ratio between circumferential speeds of the pinch roll and the cooling roll.

3 Claims, 10 Drawing Sheets

METHOD OF TRANSPORTING RAPIDLY QUENCHED RIBBON AND APPARATUS THEREFOR

BACKGROUND OF THE INVENTION

1. Field of the Invention

The invention relates to a method and an apparatus for transporting a rapidly quenched ribbon from a cooling roll to a winding reel.

2. Related Art Statement

The rapidly quenched ribbon such as an amorphous ribbon is produced by continuously and rapidly quenching molten metal on the surface of a cooling roll rotating at a high speed. Particularly, an amorphous ribbon having a thickness of about 30 μm is produced by rotating the cooling roll at such a high circumferential speed as in a range of 20~40 meter/sec.

Accordingly, there has been required a special means for transporting the rapidly quenched ribbon produced at such a high speed from the surface of the cooling roll to a reel.

Japanese Patent Application Laid-Open Publication No. 59-43,772 discloses an ejector type transporting means in the form of a duct having a cavity of a flat rectangular section for blowing out air as a carrier fluid at high speed. The high speed carrier fluid generates a reduced pressure within the duct lower than the atmosphere to suck the atmospheric fluid into the duct and thereby guiding the rapidly quenched ribbon from the surface of the cooling roll into the duct and transporting it to the reel by the carrier fluid. The ejector type transporting means mentioned above can stably peel the ribbon from the surface of the roll and subsequently transport it by the carrier fluid if the atmospheric fluid is not disturbed. The ejector type transporting means has however disadvantages that the suction force by means of an ejector is limited and if the ribbon is clogged in the duct or the ribbon peeling point on the surface of the cooling roll is unstably displaced up and down, the ribbon is broken at the inlet side of the duct.

Japanese Patent Application Laid-open Publication Nos. 56-12,257 and 59-138,572 disclose means for transporting the rapidly quenched ribbon comprising two brush rolls adapted to apply a tension to the ribbon by sliding resistance. There are however disadvantages in that since the rotating speed of the brush rolls is more than 30 meter/sec, the progress of the ribbon is unstable and the ribbon is easily transversely displaced owing to a difference of tension so that it is difficult to continuously transport the ribbon from the surface of the cooling roll. Furthermore, in order to apply an adequate tension, it is necessary to apply a large screw down or pressing force to the upper and lower brush rolls which results in a tendency for a breakdown of the ribbon.

Japanese Utility Model Application Laid-open Publication No. 61-167,248 discloses a ribbon transporting apparatus comprising a pinch roll including upper and lower solid rolls, an air nozzle and a guide conveyor. This transporting apparatus has however no training device and is not adapted to pass the ribbon at high speed. Furthermore, a plurality of tension applicators are sequentially arranged in the outlet side of the cooling roll and result in a large tension at the initial winding so that the ribbon is necessarily broken between the cooling roll and the pinch rolls.

Japanese Patent Application Laid-open Publication No. 59-57,864 and Japanese Patent Application Publication No. 60-48,431 disclose means comprising dancer rolls for winding the ribbon. This winding means has however a drawback such that in order to improve the shape of the wound ribbon rolls it is necessary to apply a large tension, but the cooling roll is directly affected by such a large tension to render the casting unstable.

Furthermore, Japanese Patent Application Publication No. 59-34,467 discloses an approximate magnet reel, but it has a drawback such that since the reel is adjacent to the cooling roll, a measurement and control system cannot be easily arranged so that it is difficult to stably produce the ribbon for industrialization. An inwardly blowing reel disclosed in Japanese Patent Application Laid-open Publication No. 57-3,901 is also difficult to continuously feed the ribbon from the cooling roll.

SUMMARY OF THE INVENTION

It is an object of the present invention to provide a method and an apparatus for transporting a rapidly quenched ribbon, which is continuously produced on the surface of a cooling roll rotating at high speed, to a winding reel in a stable manner under an adequate tension without transversal displacement of the ribbon.

BRIEF DESCRIPTION OF THE DRAWINGS

Further object and advantages of the present invention will become apparent as the following description of illustrative embodiments proceeds with reference to the drawings, in which.

DESCRIPTION OF THE PREFERRED EMBODIMENTS

Figure 1:
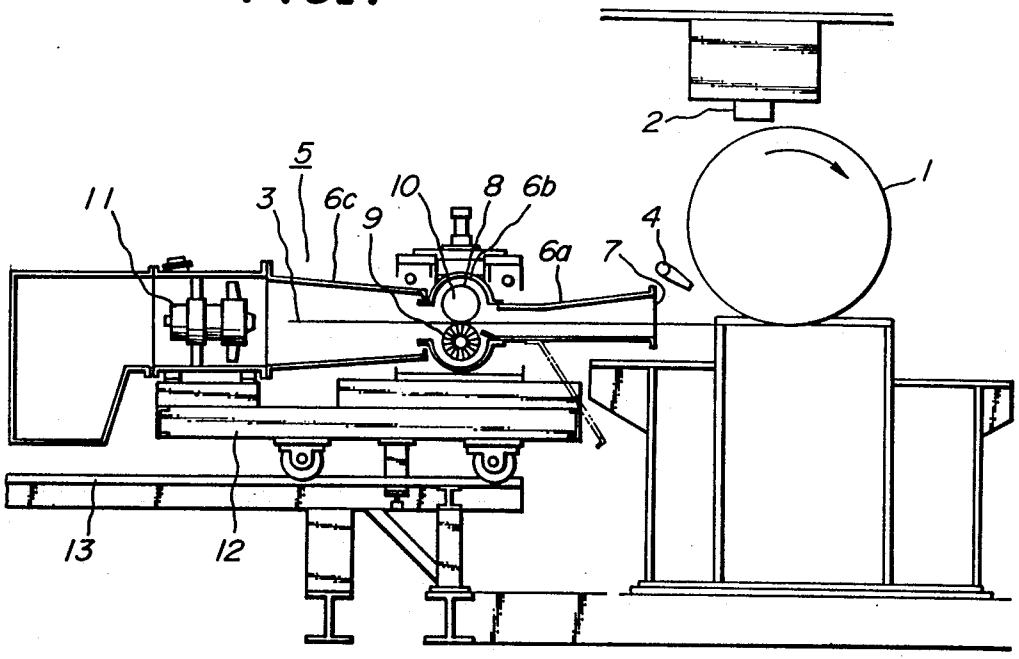
FIG. 1 is a side elevation of the transporting apparatus according to the invention in partly section.

The present invention will be more fully described with reference to the accompanying drawings. Referring to FIG. 1 illustrating an embodiment of the apparatus for transporting a rapidly quenched ribbon according to the present invention, the numeral 1 designates a cooling roll adapted for rapidly quenching molten metal from a pouring nozzle 2 to produce a rapidly quenched ribbon 3 which is peeled from the surface of the cooling roll 1 by means of an air jet of an air knife 4.

The transporting apparatus 5 includes an inlet duct hood 6*a* having a suction inlet 7 directing in the tangential direction with respect to the outer periphery of the cooling roll for providing a passage for transporting the ribbon. Within a housing hood 6*b*, there is provided a pinch roll 8 which comprises a lower brush roll 9 and an upper solid roll 10 and a suction blower 11 arranged at the outlet side of the pinch roll 8 in an outlet duct hood 6*c*. The hood 6*b* and 6*c* including the pinch roll 8 and the suction blower 11 is mounted on a truck 12 which is movable on rails 13 which extend from a position adjacent to the cooling roll 1 towards a winding reel.

Figure 2:
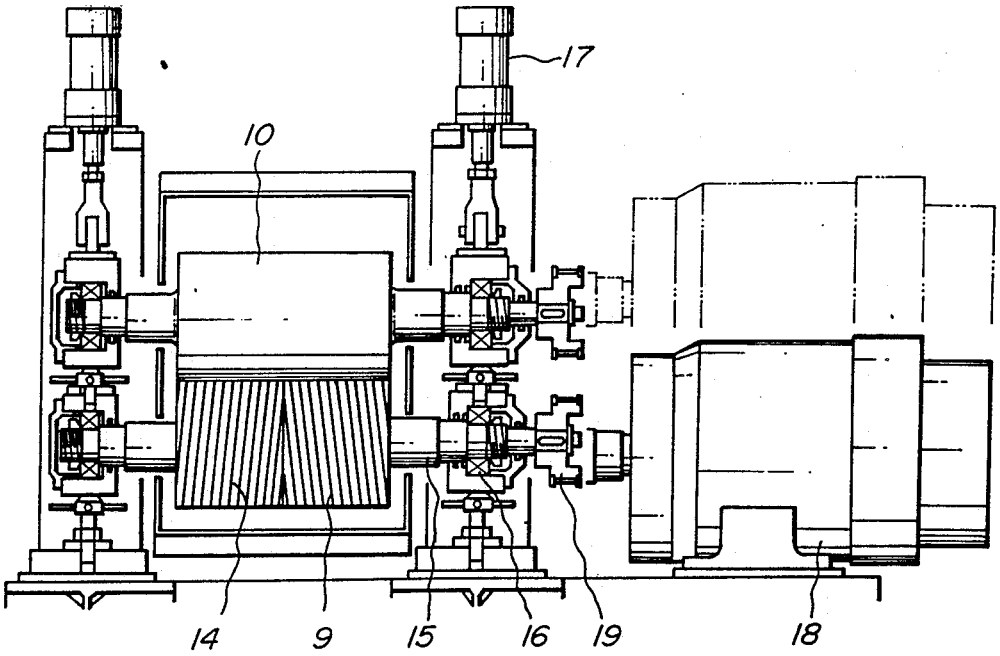
FIG. 2 is a front elevation of the pinch roll according to the invention.
Figure 3:
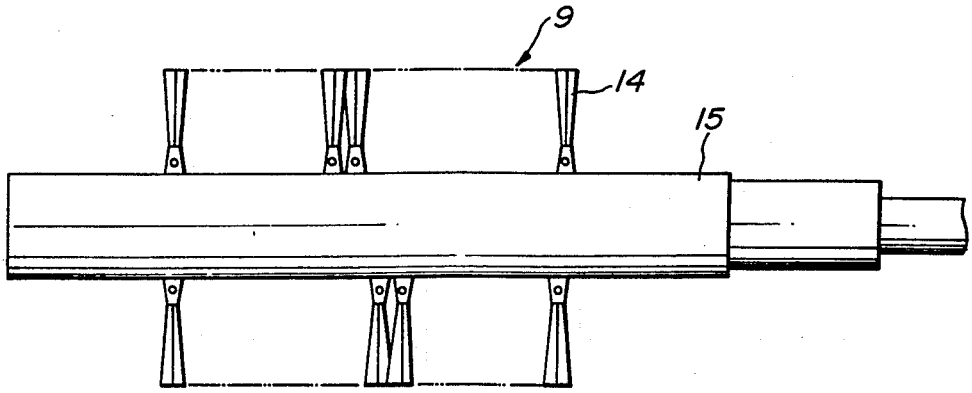
FIG. 3 is an enlarged sectional view of the brush roll.

The brush roll 9 has a brush 14 composed of a belt of metal wires such as stainless steel fibers wound around a roll shaft 15 in the form of a single or double helix (FIG. 2). The roll shaft 15 is rotatably supported at the opposite ends by means of bearings each of which is operated up and down by a pneumatic or hydraulic pressing cylinder 17. The roll shaft 15 is also connected to a motor 18 by means of a pulley coupling 19 as shown in FIG. 2.

Preferably, in order to prevent the ribbon from transversely displacing, the roll shaft 15 is provided with the brush 14 wound in the form of double helix consisting of clockwise and anticlockwise half portions at the opposite sides of the center and the solid roll 10 is shaped by a radial crown having a larger diameter at the center portion than that at the opposite ends of the roll barrel or a tapered crown so that the pressing force by the brush roll 9 becomes large at the central portion in the width direction of the ribbon to force it to pass in the center of the roll without any transverse displacement.

The brush roll 9 is pressed against the solid roll 10 by means of a pneumatic or hydraulic pressing cylinder 17 to apply a tension to the ribbon 3 by a sliding resistance between the brush roll 9 and the solid roll 10. Thus, the tension of the ribbon can be controlled by at least one of the pressing forces of the pinch roll, an amount of pressing of the brush roll 9 against the solid roll 10 and the ratio between circumferential speeds of the pinch roll 8 and the cooling roll 1.

The amount of pressing of the brush roll against the solid roll is defined by the difference in distance between axes of the brush roll 9 and the solid roll 10 when the brush roll 9 is pressed against the solid roll and the distance between axes of both rolls when the brush 14 of the brush roll initially contacts the surface of the solid roll 10.

The material of the brush 14 may be selectively used from various material according to the material and other properties of the ribbon to be transported without limiting to the material mentioned above. The shape of the solid roll 10 and the kind of helical winding of the brush 14 may be selectively determined according to the transporting speed and the amount of the transversal displacement.

The brush roll 9 may be positioned above the solid roll 10 so that the pinch roll 8 comprises an upper brush roll and a lower solid roll, if necessary.

Figure 4:
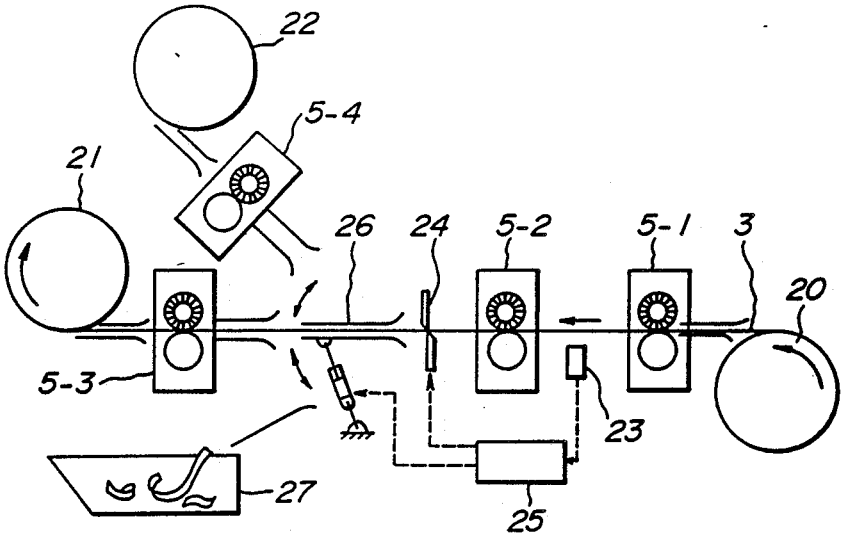
FIG. 4 is a schematic view illustrating an arrangement of the transporting apparatuses for transporting a ribbon from one reel to another.

FIG. 4 illustrates an arrangement of the transporting apparatus 5 as shown in FIGS. 1 and 2 for transporting the rapidly quenched ribbon from one reel 20 to other reels 21 and 22.

In this arrangement, the ribbon 3 is unwound from a reel 20 by means of a first transporting apparatus 5-1 and is checked by means of a defect detector 23. After checking, the ribbon 3 is transported by a second transporting apparatus 5-2 to a shear 24. When the defect detector 23 detects a defect in the ribbon 3 to provide an output signal to a controller 25, the shear 24 and a movable guide 26 are actuated by their actuators in response to signals from the controller to cut the defective ribbon and reject it into a scrap box 27. The ribbon having no defect is directed to a third or fourth transporting apparatuses 5-3 or 5-4 by the movable guide 26 and is then wound on the reel 21 or 22. During the transportation mentioned above, the ribbon can be transported under an adequate tension by the transporting apparatus 5-1~5-4 without any transversal displacement.

Figure 5:
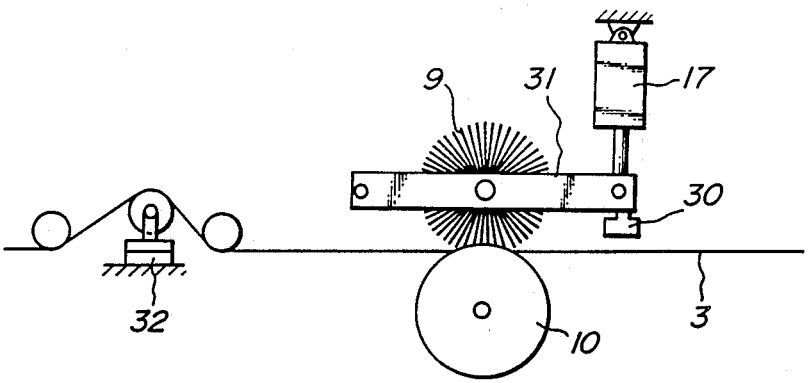
FIG. 5 is a schematic side view illustrating an embodiment of the transporting apparatus provided with means for measuring the pressing force and the tension applied to the ribbon.

FIG. 5 illustrates an embodiment of the transporting an apparatus provided with a load cell 30 on an arm 31 supporting the brush roll 9 for measuring the pressing force of the pressing cylinder and a tension meter 32 for measuring the tension applied to the ribbon 3.

Figure 6:
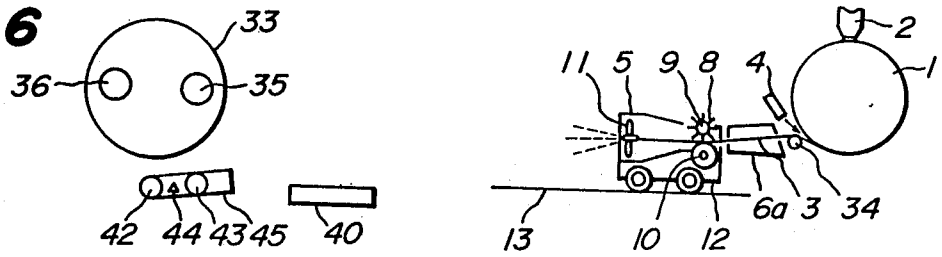
FIG. 6 is a schematic side view illustrating another embodiment for transporting a ribbon from a cooling roll to a winding reel.
Figure 7:
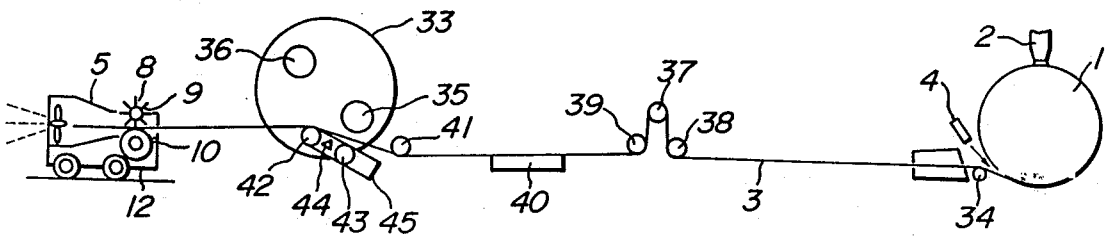
FIGS. 7 and 8 is a schematic side view similar to FIG. 6 illustrating the operation of the transporting apparatus.
Figure 8:
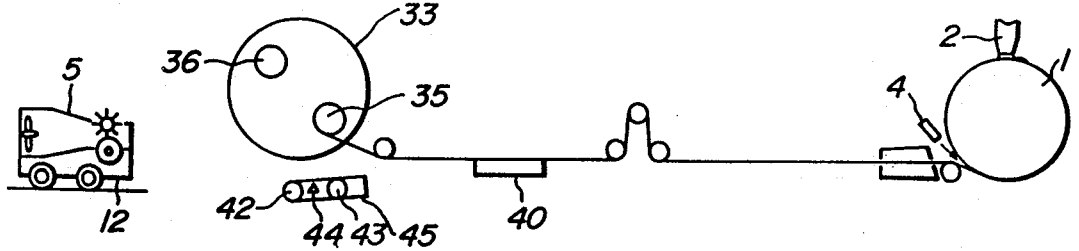

FIGS. 6~8 illustrate another arrangement for transporting the rapidly quenched ribbon 3 from the cooling roll 1 to winding reels 35 and 36 of a revolving wheel 33. Referring FIG. 6, a ribbon 3 rapidly quenched on the surface of the cooling roll 1 is peeled by air et from the air knife 4 and sucked into the inlet duct hood 6*a* by suction force of the suction blower 11. In the housing hood 6*b*, the ribbon 3 passes between the brush roll 9 and the solid roll 10 of the pinch roll 8 and an irregular front end portion of the ribbon 3 is removed by sucking action of the blower 11. The brush roll 9 is pressed against the ribbon 3 on the solid roll 10 by the pressing cylinder to apply a predetermined tension of 2~8 kgf to the ribbon such as to stabilize the pass line of the ribbon. In this stage, the ribbon is continuously peeled from the cooling roll 1 and regularly guided by means of a deflector roll 34.

The truck 12 carrying the pinch roll 8 is then moved towards the revolving wheel 33 to maintain a tension within a range of 2~8 kgf applied to the ribbon. It is preferable to maintain a relation of $V_1 > V_2 \gg V_3$ between a circumferential speed $V_1$ of the pinch roll 8, a transporting speed $V_2$ and a moving speed $V_3$ of the truck 12.

Referring FIG. 7 which illustrates a condition just before the ribbon is wound on winding reels 35 and 36 of the revolving wheel 33 after the truck 12 has passed beyond the revolving wheel 33, the ribbon 3 is contacted with a dancer roll 37, deflector rolls 38 and 39, a tension separator 40 and deflector rolls 41 and 42 to prepare for winding the ribbon on the reels 35 and 36. Subsequently, a revolving wheel 33 including the reels 35 and 36 is revolved to approach the first winding reel 35 to the ribbon 3. Thus, the ribbon 3 is transported from pinch roll 8 to the winding reel 35 by a cutting machine 45 which comprises a deflector roll 42, a pressing roll 43 and a knife 44.

Further referring FIG. 8, the ribbon 3 is cut by means of the knife 44 to separate from the ribbon portion held by the pinch roll 8 of the transporting apparatus and simultaneously the pressing roll 43 presses the cut end of the ribbon against the reel 35 which can continuously take up the ribbon.

The winding speed of the reel 35 is preferably controlled to provide an adequate tension by detecting and adjusting the position of the dancer roll 37.

The tension separator 40 operates to separate the tension of the ribbon such as to maintain a necessary high tension between the separator 40 and the winding reel 35 and a low tension between the separator 40 and the cooling roll 1.

It is important to maintain the ribbon to be transported under a tension within a range of 2~8 kgf in order to stabilize the transportation of the ribbon because under a lower tension than 2 kgf the ribbon slackens so that transversal displacement can occur in the duct hood before or at the pinch roll, thereby allowing the ribbon to strike against the inner side wall of the duct hood or moving the ribbon out the pinch roll so that the ribbon is broken. Furthermore, under such a low tension, the peeling point at which the ribbon is peeled from the surface of the cooling roll is displaced and the ribbon is flapped up and down when the thickness of the ribbon is varied, causing the pass line to become unstable, so that the ribbon is broken before the pinch roll.

While under a higher tension than 8 kgf the ribbon may break at the pinch roll owing to defects such as a crack and pit in the ribbon or an abrupt variation of the tension by increase of the coefficient of friction between the brush roll and the solid roll or by winding to the rolls.

When the ribbon is initially passed to the pinch roll, an adequate tension is applied to the ribbon by controlling the amount of pressing of the brush roll, the pressing force of the pressing cylinder and the ratio between circumferential speeds of the pinch roll and the cooling roll.

When the tension applied to the ribbon is varied beyond the desired range owing to variation of peeling point on the cooling roll, variation of thickness of the ribbon, transversal displacement of the ribbon or the like during transporting the ribbon, the tension must be controlled by adjusting at least one of the amount of pressing of the brush roll, the pressing force of the pressing cylinder, and the ratio between the circumferential speeds of the pinch roll and the cooling roll.

Figure 10:
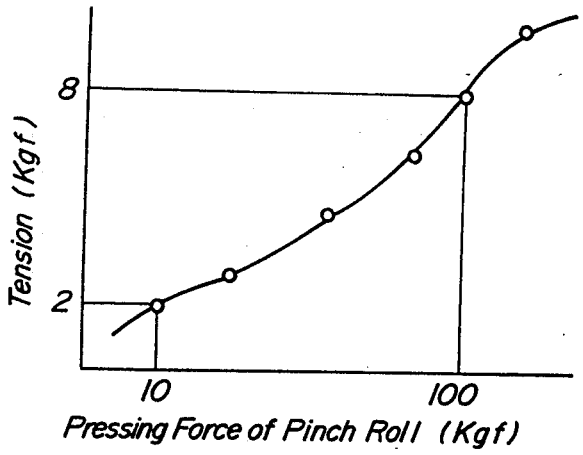
FIG. 10 is a diagram showing a correlation between the tension applied to the ribbon and the pressing force of the pinch roll.
Figure 11:
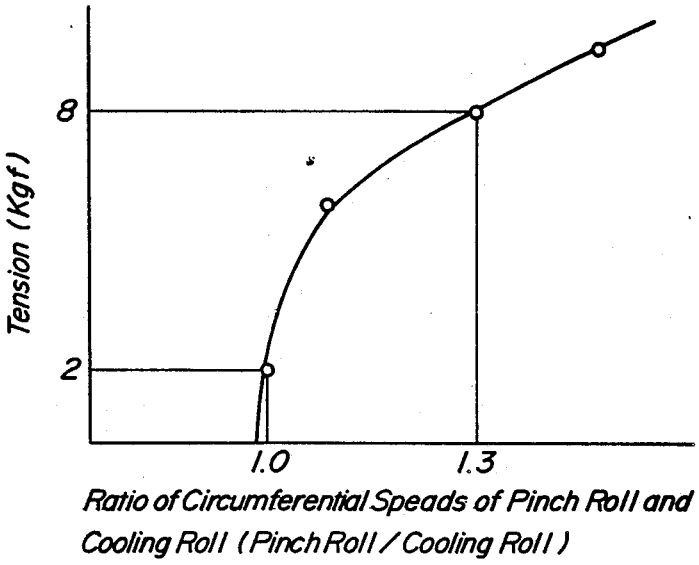
FIG. 11 is a diagram showing a correlation between the tension applied to the ribbon and the ratio of circumferential speeds of the pinch roll and the cooling roll.

A series of test were carried out to determine the relationship between the tension applied to the ribbon and the amount of pressing of the brush roll, the pressing force of the pressing cylinder and the ratio between the circumferential speeds of the pinch roll and the cooling roll. In the tests, the transporting apparatus as shown in FIG. 5 was used and a rapidly quenched ribbon having a width of 100 mm and a thickness of 30 μm was initially passed between the brush roll and the solid roll. The results of the tests are shown in FIGS. 9~11.

Figure 9:
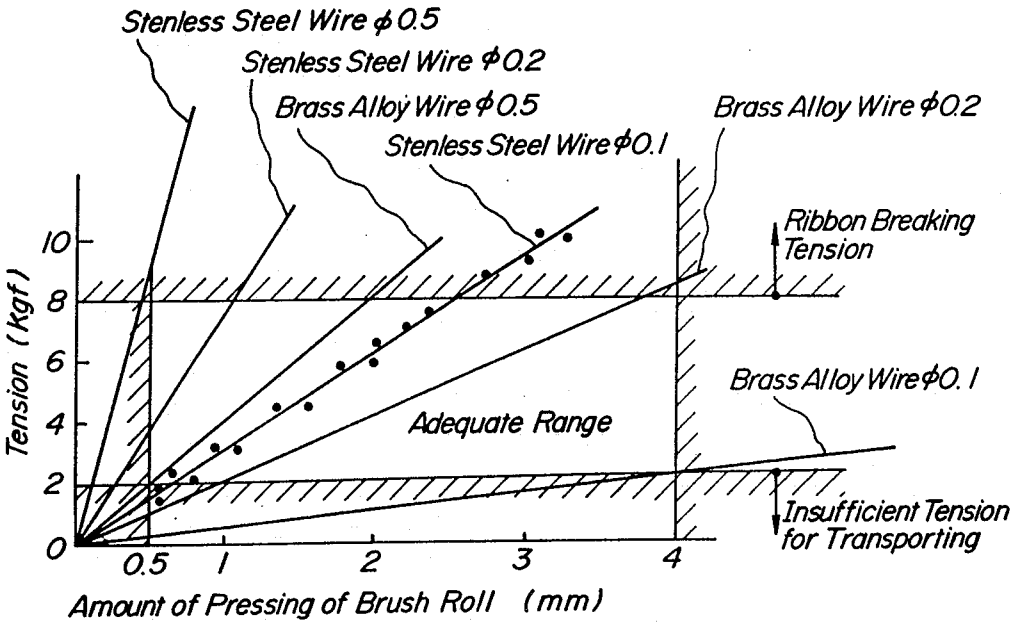
FIG. 9 is a diagram showing a correlation between the tension applied to the ribbon and the amount of pressing of the brush roll against the solid roll.

FIG. 9 is a diagram showing various relation between the amount of pressing of the brush roll and the tension applied to the ribbon when the ribbon was initially passed between the brush rolls having an outer diameter of 200~350 mm and a solid roll under a condition of the ratio between the circumferential speeds of the pinch roll and the cooling roll of 1.0.

It will be seen from the diagram shown in FIG. 9 that there is a correlation between the amount of pressing of the brush roll and the tension applied to the ribbon and it is possible to apply a tension within the range of 2~8 kgf to the ribbon by control the amount of pressing of the brush roll to keep it within a range. The proper range of the amount of pressing of the brush roll is however different according to the material and the diameter of the metal wire of the brush so that it is necessary to adjust the range in corresponding to the selected brush roll.

Generally the pressing or screw down force corresponds to the amount of pressing of the roll when the pinch roll comprises a pair of conventional solid rolls. However, the pinch roll according to the present invention comprises a brush roll and a solid roll so that the amount of pressing of the brush roll does not correspond to the pressing force owing to the material and diameter of metal wires, the used duration and the loading condition of the brush roll. Accordingly, the tension applied to the ribbon is effectively controlled by adjusting the pressing force by the pressing cylinder as shown in FIG. 10 which shows a correlation between the tension applied to the ribbon and the pressing force of the pressing cylinder as a result from a series of tests. In the tests, a brush roll having brushes of stainless steel fibers of 0.1 mm diameter was used and the ratio between the circumferential speeds of the pinch roll and the cooling roll was 1.0. Additionally other brush rolls rather than the stainless steel fiber brush roll were tested under the same condition. It is seen from results of these tests that the tension applied to the ribbon is advantageously maintained in the range of 2~8 kgf by adjusting the pressing force within a range of 10~100 kgf under a condition that a ratio between the circumferential speeds of the pinch roll and the cooling roll is between 1.0 and 1.3.

FIG. 11 shows the correlation between the tension applied to the ribbon and the ratio of the circumferential speeds of the pinch roll and the cooling roll when a brush roll having a brush of brass alloy wires (0.2 mmϕ) is pressed against a solid roll by an amount of pressing of 1 mm. It is seen from the FIG. 11 that when the ratio is lower than 1.0, the tension becomes lower than 2 kgf to slacken the ribbon and when the ratio is higher than 1.3, the tension becomes higher than 8 kgf to break the ribbon. Additionally, other brush rolls were tested under the same condition. It is seen from results of these tests that the tension applied to the ribbon is advantageously maintained in the range of 2~8 kgf by adjusting the ratio within in the range of 1.0~1.3 when the amount of pressing is 1 mm.

Figure 12:
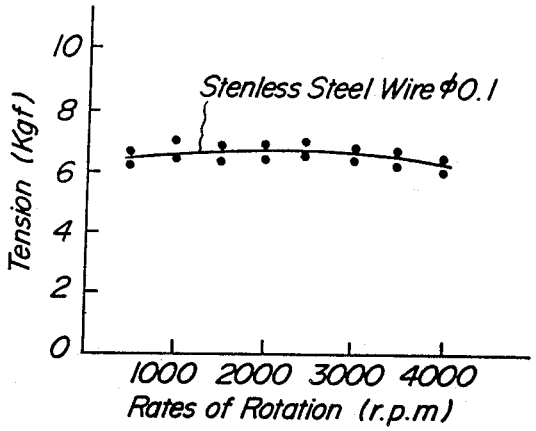
FIG. 12 is a diagram showing a relation between the tension applied to the ribbon and rates of rotation of the pinch roll.
Figure 13:
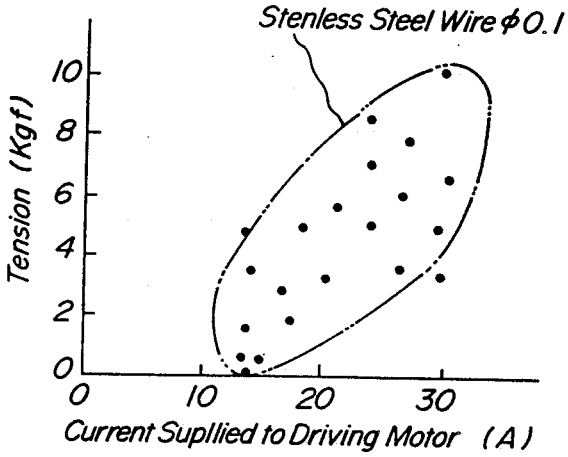
FIG. 13 is a diagram showing variations of the tension applied to the ribbon by changing an electric current supplied to a motor driving the pinch roll.

FIGS. 12 and 13 show diagrams showing variation of tensions applied to a ribbon having a width of 100 mm and a thickness of 30 μm by changing rates of rotation of the driving motor connected to the brush roll and current supplied to the driving motor. It can be seen from these FIGS. 12 and 13 that there is no correlation between the circumferential speed of the brush roll and the tension and also between the current and the tension which is largely varied.

EXAMPLE 1

An apparatus as shown in FIG. 5 was used to transport a rapidly quenched ribbon of Fe-Si-B amorphous alloy to a winding reel at a circumferential speed of 33 m/sec of a solid roll and a brush roll as described below. The amount of pressing of brush roll, the pressing force and the ratio of circumferential speeds at the initial pass were changed as shown in Table 1 and the tension, amount of transversal displacement and stability of the ribbon were measured. The results of these measurement are shown in Table 1 together with results of comparative tests carried by using pinch rolls comprising a pair of brush rolls and a pair of solid rolls, respectively.

(1) Solid roll (crown roll)

| | |
|---|---|
| (1) Solid roll (crown roll) | |
| Diameter of roll | 201 mm at center<br>200 mm at opposite ends |
| Length of roll barrel | 250 m |
| Material of roll | S45C |
| (2) Brush roll | |
| Diameter of roll | 200 mm |
| Length of roll barrel | 250 mm |
| Diameter of roll shaft | 50 mm |
| Material of roll shaft | S45C |
| Diameter of brush wire | 0.1 mm |
| Material of brush wire | stainless steel fiber |
| Type of brush | Double helical windings of clock wise and anticlockwise half portions separated at the center of the roll such as to center the ribbon in the passing direction. |

Figure 14:
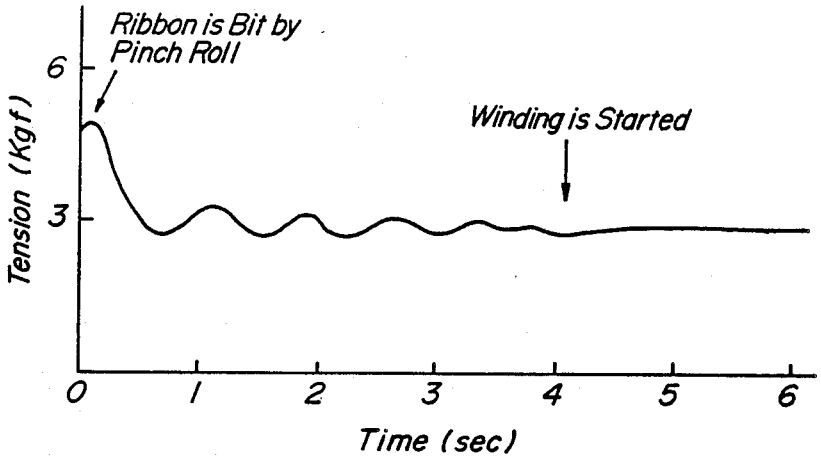
FIGS. 14~16 are diagrams showing variations of the tension applied to the ribbon during transporting.

Length of roll barrel: 250 m
Material of roll: S45C (2) Brush roll
Diameter of roll: 200 mm
Length of roll barrel: 250 mm
Diameter of roll shaft: 50 mm
Material of roll shaft: S45C
Diameter of brush wire: 0.1 mm
Material of brush wire: stainless steel fiber
Type of brush: Double helical windings of clock wise and anticlockwise half portions separated at the center of the roll such as to center the ribbon in the passing direction.

through the pinch roll as described below under a tension of 4 kgf. After two seconds, the tension was varied and then the amount of pressing was adjusted to stabilize the tension as shown in FIG. 14. The initial pass conditions of the amount of pressing of 0.5 mm, pressing force of 20 kgf and the ratio of circumferential speed of 1.2 was used.

(1) Solid roll (flat roll)
Diameter of roll: 80 mm
Length of roll barrel: 170 mm
Material of roll: S45C (2) Brush roll
Diameter of roll: 80 mm
Length of roll barrel: 170 mm
Diameter of roll shaft: 25 mm
Material of roll shaft: S45C
Diameter of brush wire: 0.2 mm
Material of brush wire: stainless steel fiber
Type of brush: Closely spirally wound around the roll shaft by clockwise or anticlockwise winding.

COMPARATIVE EXAMPLE 1

Figure 15:
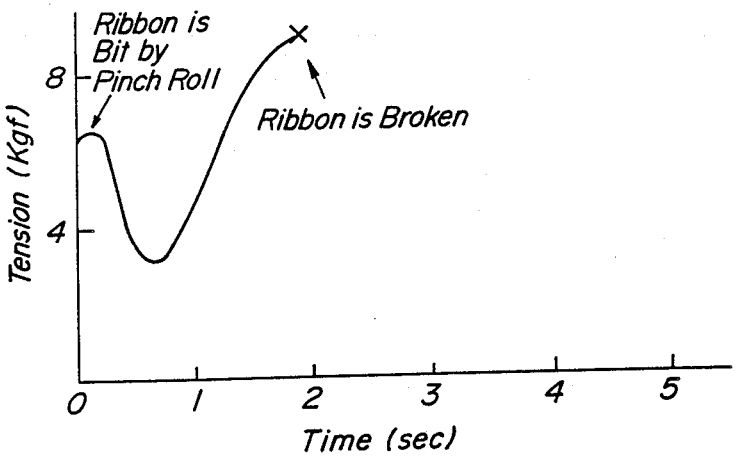
Figure 16:
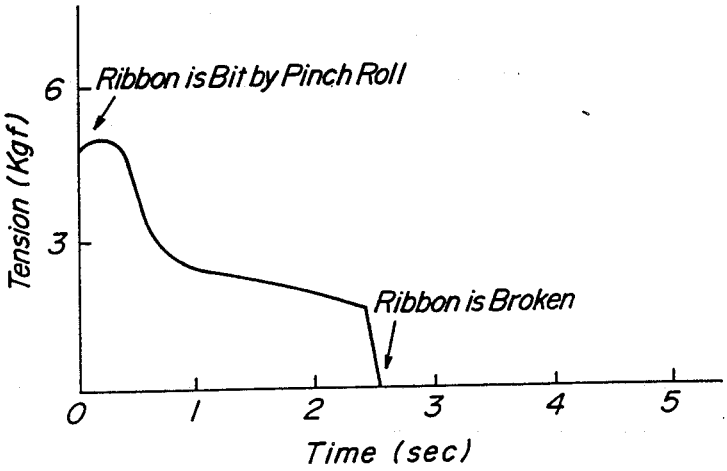

A pinch roll comprising a pair of solid rolls as described below was used. A rapidly quenched ribbon of Fe-Si-B amorphous alloy was guided to the pinch roll. When the ribbon was bit by the pinch roll, a variation of tension as shown in FIG. 15 generates and after several seconds the ribbon was broken. Accordingly, the ribbon could not be transported to a winding reel.

(1) Solid roll (upper crown roll)

| | |
|---|---|
| (1) Solid roll (upper crown roll) | |
| Diameter of roll | 83 mm at center,<br>80 mm at opposite ends |
| Length of roll barrel | 70 mm |
| Material of roll | S45C |
| (2) Solid roll (lower flat roll) | |
| Diameter of roll | 80 mm |

TABLE 1

| | Brush roll and solid roll | | | | | | | | | Pair of brush rolls | |
|---|---|---|---|---|---|---|---|---|---|---|---|
| Type of transportation Brush wire | Stainless steel fiber (0.1 mmϕ) | | | | | | Stainless steel fiber (0.5 mmϕ) | | Brass alloy wire (0.1 mmϕ) | Stainless steel (0.2 mmϕ) | Pair of solid rolls — |
| Pressing amount (mm) | 2 | 1 | 2.5 | 3 | 1.5 | 0.5 | 0.5 | — | 5 | 1.5 | — |
| Pressing force (kgf) | 80 | 30 | 100 | 150 | 50 | 10 | 150 | 5 | 50 | 100 | 10 |
| Ratio of circumferential speeds (pinch roll/cooling roll) | 1.0 | 1.2 | 1.0 | 1.2 | 0.8 | 1.5 | 1.0 | 1.2 | 1.0 | 1.0 | 1.0 |
| Tension (kgf) | 6 | 7 | 8 | >12 | 0 | >9 | >9 | 1.5 | 2.5 | 4 | 6 |
| Variation of tension | ±0.2 | ±0.3 | ±0.2 | ±0.5 | — | ±0.8 | ±2 | ±0.5 | ±0.0 | ±3 | ±0.3 |
| Amount of transversal displacement (T.D.) | ±5 | ±5 | ±5 | ±5 | ±50 | ±20 | ±10 | ±7 | ±10 | ±50 | ±30 |
| Result | >10 min. | >10 min. | >10 min. | Breakdown of ribbon | T.D. breakdown of ribbon | Breakdown of ribbon | Breakdown of ribbon | Slack and T.D. breakdown of ribbon | Breakdown of brush | Breakdown of ribbon after 3 min. | Breakdown at start of passing ribbon |
| Note | | Invention | | | | | Comparative Example | | | | |

EXAMPLE 2

An apparatus as shown in FIG. 5 was used to transport a rapidly quenched ribbon of Fe-Si-B amorphous alloy to a winding reel. The ribbon was initially passed -continued

| | |
|---|---|
| Length of roll barrel | 70 mm |
| Material of roll | S45C |

Length of roll barrel: 70 mm
Material of roll: S45C
(2) Solid roll (lower flat roll)
Diameter of roll: 80 mm
Length of roll barrel: 70 mm
Material of roll: S45C

COMPARATIVE EXAMPLE 2

A pinch roll comprising a pair of brush rolls as described below was used in place of the pinch roll comprising the brush roll and the solid roll in the transporting apparatus as shown in FIG. 5. A rapidly quenched ribbon of Fe-Si-B amorphous was guided to the pinch roll. When the ribbon was bit by and initially passed through the pinch roll, the ribbon slacked and transversally displaced. After short run, the ribbon was broken and could not be transported to a winding reel. When the ratio between the circumferential speeds of the pinch roll (brush rolls) and the cooling roll was decreased to 0.9 and the ribbon slacked, the rate of rotation of the pinch roll was controlled to increase the ratio to 1.0 or more and the pressing force was set to 20 kgf or more, but the slack of the ribbon could not be removed and the break of the ribbon could not be prevented.

Brush roll (both the upper and lower rolls)
Diameter of roll: 80 mm
Length of roll barrel: 170 mm
Diameter of roll shaft: 25 mm
Material of roll shaft: S45C
Diameter of brush wire: 0.2 mm
Material of brush wire: stainless steel fiber
Type of brush: closely spirally wounded around roll shaft.

COMPARATIVE EXAMPLE 3

A pinch roll comprising a solid roll and a brush roll as shown in FIG. 5 was used in the transporting apparatus to transport a rapidly quenched ribbon of Fe-Si-B amorphous to a winding reel. Under a condition of a pressing force of 100 kgf and a ratio between circumferential speeds of 1.3, the ribbon was bit and then initially passed through the pinch roll to apply a tension of 8 kgf to the ribbon. After two seconds, the ribbon was transported to the winding reel. As a result, the ribbon peel point was displaced on the cooling roll and the pressing force increased up to 150 kgf to break the ribbon before the pressing force can be decreased. Accordingly, the ribbon could not be wound on the winding reel.

What is claimed is:

1. An apparatus for transporting a rapidly quenched ribbon to a winding reel, said apparatus comprising an inlet duct hood, a housing hood connected to a rear end of the inlet duct hood, an outlet hood connected to rear end of the housing hood, a pinch roll pair consisting of a brush roll and a solid roll arranged in the housing hood, a suction blower arranged in the outlet hood, and a truck carrying the hoods including the pinch roll and the suction blower.

2. An apparatus claimed in claim 1, wherein the truck is movable along a pass line extending through one side of a winding reel from a position adjacent to a cooling roll.

3. An apparatus claimed in claim 2, wherein a cutting machine comprising a knife, a pressing roll and a deflector roll is arranged near the winding reel.

* * * * *